US009314124B2

(12) United States Patent
Barre et al.

(10) Patent No.: US 9,314,124 B2
(45) Date of Patent: Apr. 19, 2016

(54) ARTICULATING GARMENT HANGER

(71) Applicant: Neatfreak Group Inc., Mississauga (CA)

(72) Inventors: Bertrand Barre, Lapeyrouse (FR); Francis Lepage, Dommartin (FR)

(73) Assignee: NEATFREAK GROUP INC., Mississauga, Ontario (CA)

( * ) Notice: Subject to any disclaimer, the term of this patent is extended or adjusted under 35 U.S.C. 154(b) by 0 days.

(21) Appl. No.: 14/098,676

(22) Filed: Dec. 6, 2013

(65) Prior Publication Data

US 2015/0157156 A1 Jun. 11, 2015

(51) Int. Cl.

| | |
|---|---|
| ***A47G 25/48*** | (2006.01) |
| ***A47G 25/34*** | (2006.01) |
| ***A41D 27/22*** | (2006.01) |

(52) U.S. Cl.

CPC ..... *A47G 25/48* (2013.01); *A41D 27/22* (2013.01); *A47G 25/34* (2013.01); *A47G 25/483* (2013.01); *A47G 2025/484* (2013.01)

(58) Field of Classification Search

CPC ..... A47G 25/14; A47G 25/48; A47G 25/34; A47G 25/22; A47G 25/40; A47G 25/4015; A47G 25/4023; A47G 25/481; A47G 25/482; A47G 25/483; A47G 2025/484; A41D 27/22; A47F 7/19; A47F 7/22; A47F 1/00

USPC ..... 223/85, 87, 91, 96, 88, 90; 24/515, 521, 24/562; D6/323, 326

See application file for complete search history.

(56) References Cited

U.S. PATENT DOCUMENTS

| | | | | |
|---|---|---|---|---|
| 883,785 | A | 4/1908 | Cazier | |
| 1,515,489 | A | 11/1924 | Johnson | |
| 2,337,723 | A | 12/1943 | Levin | |
| 2,352,147 | A * | 6/1944 | Clark | 24/329 |
| 2,467,623 | A | 4/1949 | Lamothe | |
| 2,481,206 | A | 9/1949 | Eaton | |
| 3,405,429 | A | 10/1968 | Vazquez | |
| 3,487,984 | A * | 1/1970 | Loscalzo et al. | 223/96 |
| 3,698,043 | A | 10/1972 | Batts | |
| 3,744,686 | A | 7/1973 | Levitin | |
| 3,745,616 | A | 7/1973 | Batts | |
| 3,823,855 | A | 7/1974 | Dohring | |

(Continued)

FOREIGN PATENT DOCUMENTS

DE 3821214 C1 11/1989

OTHER PUBLICATIONS

Canadian Intellectual Property Office, International Search Report and Written Opinion, issued Feb. 2, 2015 in related PCT Application No. PCT/CA2014/051087.

(Continued)

*Primary Examiner* — Ismael Izaguirre

(74) *Attorney, Agent, or Firm* — Patzik, Frank & Samotny Ltd.

(57) ABSTRACT

A garment hanger includes a stationary member having a first jaw and an articulating member having a second jaw for gripping a garment therebetween. The relative tension between the jaws is finely adjustable through the click-stop engagement of teeth associated with the articulating member and a locking member. The locking member is rotatably coupled to the stationary member, and includes a gear having a set of teeth that engage a corresponding set of teeth disposed on a surface of the articulating member.

12 Claims, 10 Drawing Sheets

(56) References Cited

U.S. PATENT DOCUMENTS

| | | | | |
|---|---|---|---|---|
| 4,209,879 | A * | 7/1980 | Paajanen | 24/519 |
| 4,536,924 | A | 8/1985 | Willoughby | |
| 4,609,132 | A | 9/1986 | Brokenshire | |
| 4,807,334 | A * | 2/1989 | Blanchard | 24/487 |
| 5,027,480 | A | 7/1991 | Hogarth | |
| D323,247 | S | 1/1992 | Chen | |
| 5,297,706 | A | 3/1994 | Blitz | |
| 5,350,092 | A | 9/1994 | Hollis | |
| 5,657,518 | A | 8/1997 | Hunt | |
| D471,367 | S | 3/2003 | Laguelle | |
| D499,893 | S | 12/2004 | Lambert | |
| D628,817 | S | 12/2010 | Song et al. | |
| 2002/0158091 | A1 | 10/2002 | Matkovich | |
| 2010/0313390 | A1 * | 12/2010 | Lo | 24/521 |

OTHER PUBLICATIONS

Machine generated English translation of German application No. DE3821214C1, Jan. 19, 2015.

* cited by examiner

ARTICULATING GARMENT HANGER

BACKGROUND OF THE INVENTION

1. Field of the Invention

The present invention relates, in general, to garment hangers and, more particularly, to garment hangers performing a clamping function, such as for hanging pants and skirts.

2. General Background of the Invention

Garment hangers tailored for supporting pants and skirts have been known for quite some time. In one form of pant and skirt hanger, two alligator-style clips are attached to the horizontal bottom bar of an otherwise conventional hanger. These clips grip the suspended garment in only two locations, and generally provide no adjustability as to gripping tension. As a result, a very strong and, in some instances, overly strong gripping force is preselected for the alligator-style clips. In another form of pant and skirt hanger, two opposing clamping members are provided, gripping the garment over a larger surface area than the alligator-style clip-type garment hangers. While some clamping-type garment hangers may provide a certain amount of adjustability in gripping tension, they are generally limited in the amount of tension that may be selected. Moreover, they generally do not permit a desired amount of gripping tension to be selected, and to be readily loosened and readjusted, prior to locking in the selected degree of gripping tension.

BRIEF SUMMARY OF THE INVENTION

The present invention provides garment hangers that overcome may of the shortcomings of certain prior art garment hangers. In particular, garment hangers are disclosed that provide a wide degree of options in selecting a gripping tension. Moreover, garment hangers are disclosed that let a variety of different gripping tensions be readily set and evaluated by the user prior to leaving or locking a desired gripping tension in place, including in one embodiment, if necessary, readily releasing only a portion of the gripping tension. This is achieved by providing an articulating garment hanger clamping member wherein opposing sets of relatively finely meshing teeth are employed, and wherein one of the sets of teeth is adjustable in position from a first, unlocked position, wherein the opposing sets of teeth are only partially intermeshed and cooperate in a click-stop manner with each other, to a second, locked position, wherein the opposing sets of teeth are fully intermeshed, thereby locking an articulating clamping member in place, relative to a second, stationary clamping member. In another embodiment of the invention, two sets of intermeshing teeth include at least one set of teeth that are constructed of a sturdy yet somewhat yielding plastic material, enabling the application of manual force to a locking member handle to engage and disengage the teeth from each other in a back-and-forth, ratcheting manner while, at the same time, providing sufficiently strong engagement of the two sets of intermeshing teeth to permit garments to be securely gripped between arms of the hanger. Moreover, at the same time, unwanted disengaging movement of the teeth in response to the gripping force against the garments secured between the hanger arms is inhibited.

DETAILED DESCRIPTION OF THE INVENTION

Figure 1:
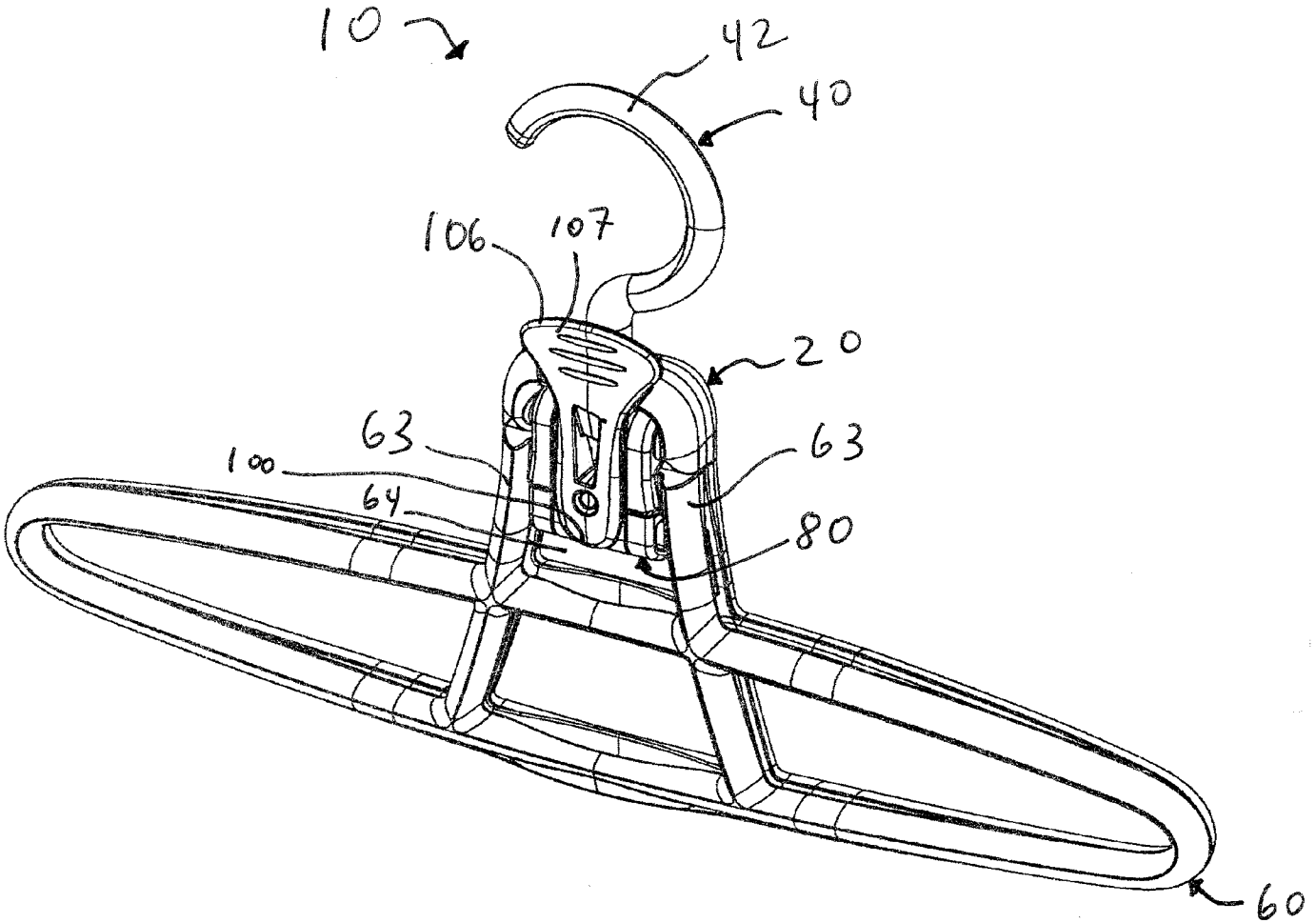
FIG. 1 an elevated, front perspective view of a first embodiment of an articulating garment hanger of the present invention, shown in the fully closed configuration.

While the present invention is susceptible of embodiment in many different forms, there is shown in the drawings and will herein be described in detail, two specific embodiments, with the understanding that the present disclosure is intended as an exemplification of the principles of the present invention and is not intended to limit the invention to the embodiment illustrated. Common reference numerals in the figures denote similar or analogous elements or structure amongst the various embodiments.

A first embodiment of the present articulating garment hanger 10 is shown in FIGS. 1 through 6 as comprising stationary member 20, swiveling hook member 40, articulating member 60, first locking member 80, and second locking member 100. Swiveling hook member 40 includes hook 42, sized for use in conjunction with a conventional closet clothing rod, and bottom cavity 41, configured to permit snap-fit attachment of hook member 40 to top pivot post 22 of stationary member 20. Upon such snap-fit engagement, hook member 40 is firmly attached to stationary member 20, yet is permitted to rotate about post 22. This, in turn, permits body 21 of stationary member 20, and all of garment hanger 10 apart from swiveling hook member 40, to rotate in place upon attachment of hook 42 to a closet clothing rod or other suitable support.

In addition to top pivot post 22, body 21 of stationary member 20 further includes two opposing vertical arms 23 having top gap 24 therebetween, stationary jaw 25 having non-slip region 26, first pivot post 27, second pivot post 28, and two opposing support posts 29. Stationary jaw 25 is substantially oval in shape, with vertical arms 23 being integrally formed therewith and extending transversely therethrough. Nonslip region 26 is likewise substantially oval in shape and is disposed about the inwardly-facing periphery of stationary jaw 25. First pivot post 27 extends longitudinally between and immediately behind each of vertical arms 23, immediately above top gap 24, permitting the pivoting attachment of articulating member 60 to stationary member 20. Second pivot post 28 extends longitudinally between and transverse to each of vertical arms 23, permitting the pivoting attachment of second locking member 100 to stationary member 20. Second pivot post 28 further facilitates the floating, loose, or partially movable attachment of first locking member 80 to stationary member 20. Support posts 29 each extend inwardly a short distance from an associated vertical arm 23, into top gap 24, permitting snap-fit engagement with an associated side recess 82 of first locking member 80. As each side recess 82 is larger in outline than its associated support post 28, this snap-fit attachment is floating, or loose, rather than fully secured, permitting the partial movement of first locking member 80 relative to support posts 28, vertically up and down within top gap 64, as well as a certain amount of movement of jaws 84 of first locking member 80 about second pivot post 28.

Figure 5:
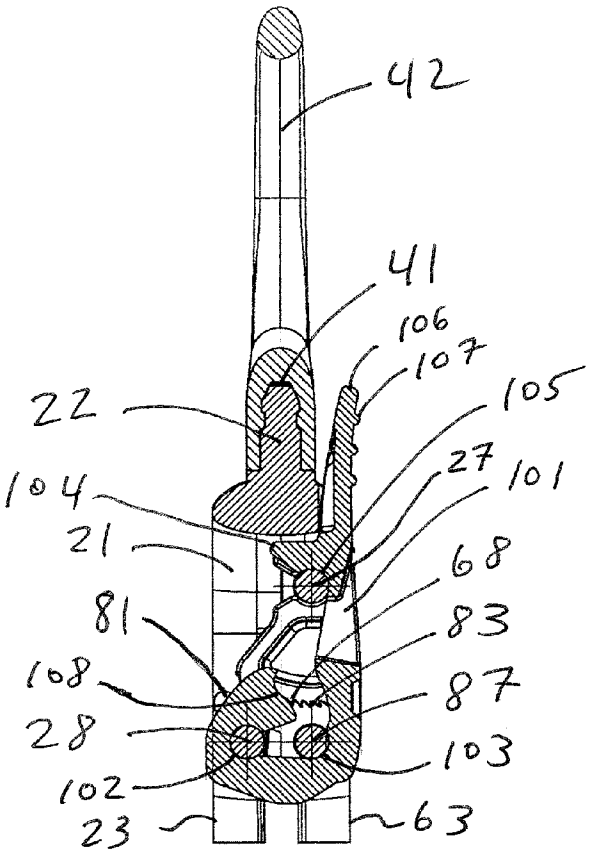
FIG. 5 is a left side sectional view of the garment hanger of FIG. 1, shown in the fully closed configuration and taken generally along lines 5-5 of FIG. 3.
Figure 4:
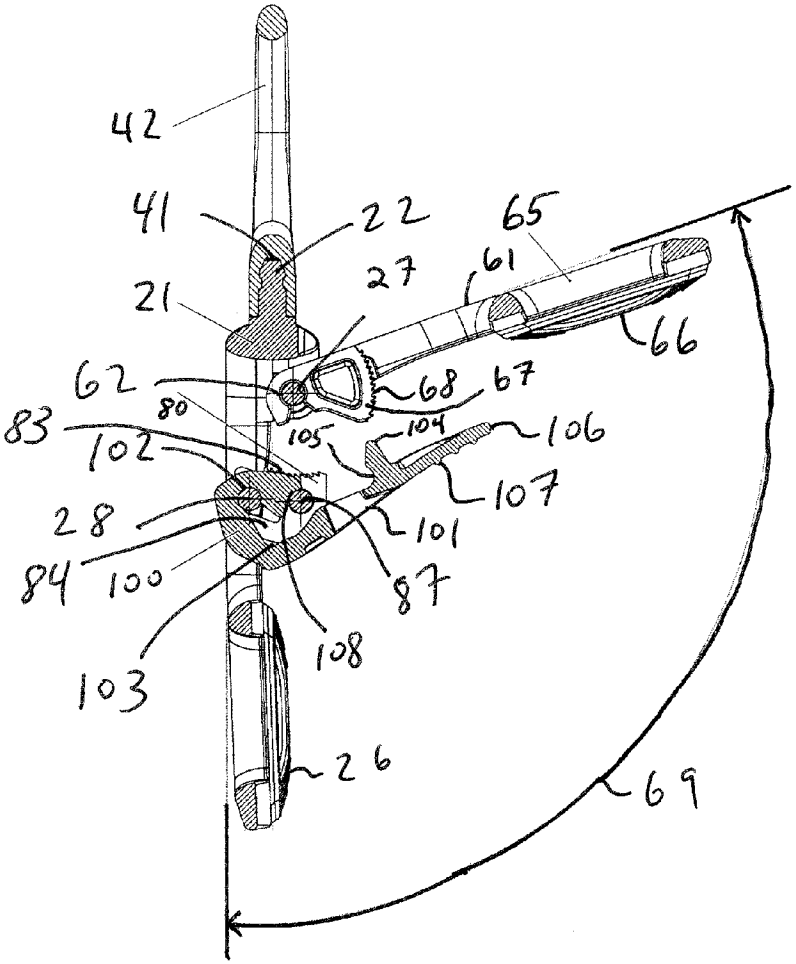
FIG. 4 is a left side sectional view of the garment hanger of FIG. 1, shown in the fully open configuration and taken generally along lines 4-4 of FIG. 2.
Figure 6A:
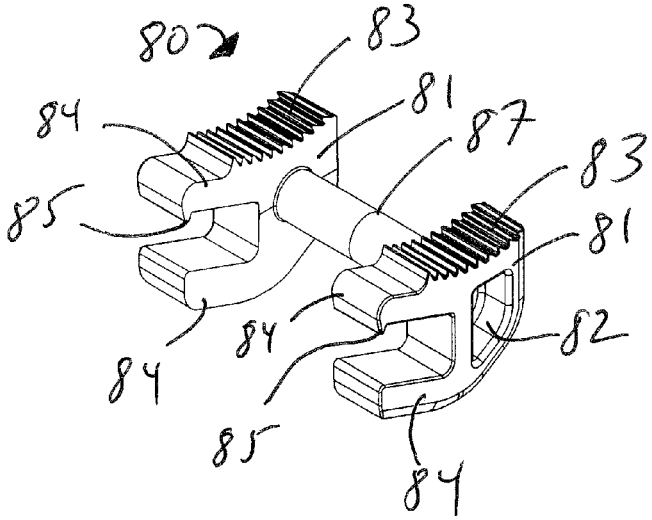
FIG. 6A is an elevated, front perspective view of the first locking member component of the articulating garment hanger of FIG. 1.
Figure 6B:
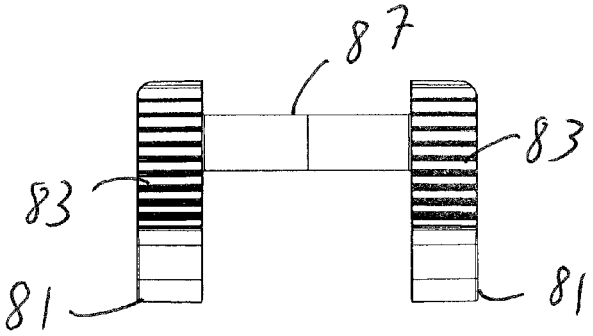
FIG. 6B is a top plan view of the first locking member component of FIG. 6A.
Figure 6C:
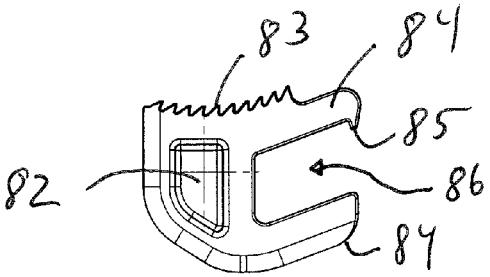
FIG. 6C is a left side view of the first locking member component of FIG. 6A.
Figure 6D:
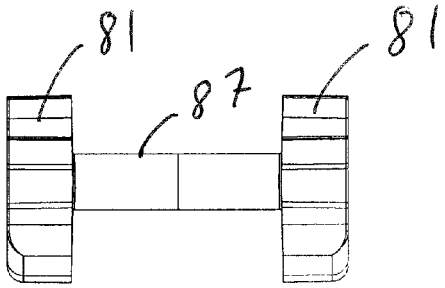
FIG. 6D is a bottom plan view of the first locking member component of FIG. 6A.
Figure 7:
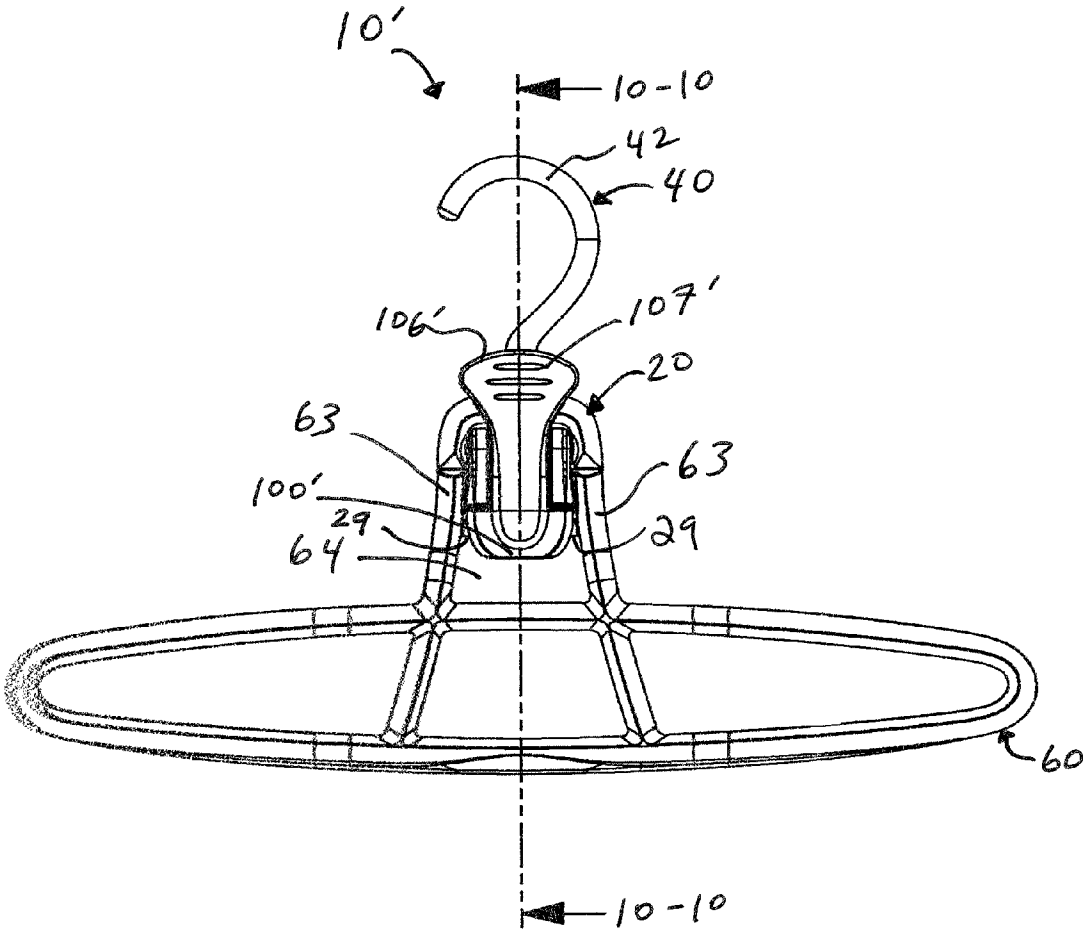
FIG. 7 is a front view of a second embodiment of an articulating garment hanger of the present invention, shown in the fully closed configuration.
Figure 8:
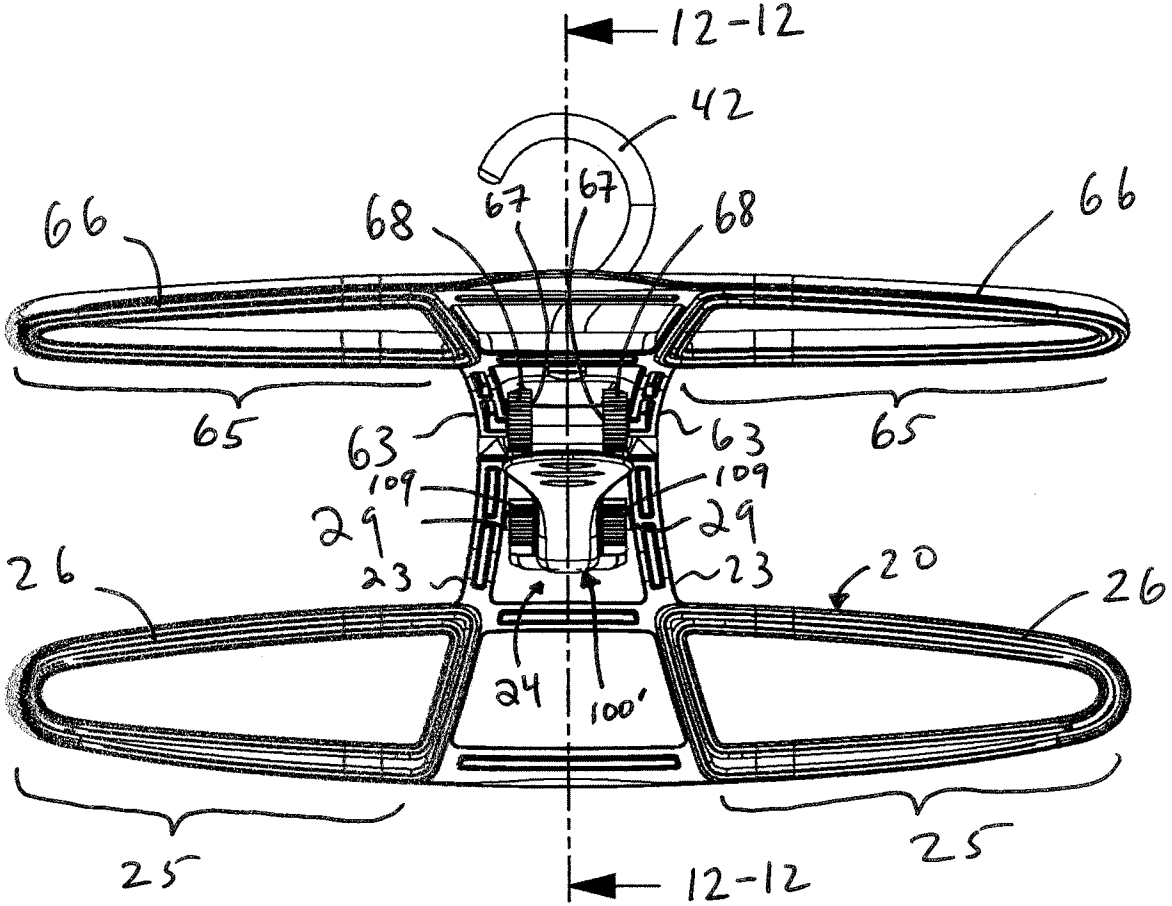
FIG. 8 is an elevated a front view of the garment hanger of FIG. 7, shown in the fully open configuration.

Articulating member 60 includes body 61 having pivot aperture 62 disposed proximate a top end, two opposing vertical arms 63 having top gap 64 therebetween, and articulating jaw 65 having non-slip region 66. Articulating jaw 65 is substantially oval in shape, with vertical arms 63 being integrally formed therewith and extending transversely therethrough. Nonslip region 66 is likewise substantially oval in shape and is disposed about the inwardly-facing periphery of articulating jaw 65. Articulating member 60 further includes articulating gear 67 proximate pivot aperture 62, and having a relatively fine set of twelve teeth 68, disposed about a slightly convex arcuate bottom surface of articulating gear 67, with the teeth canted in a direction towards the back of hanger 10 when in the fully closed orientation. As best seen in FIGS. 4 and 5, pivot aperture 62 permits articulating member 60 to be snap-fit to first pivot post 27 of stationary member 20. This, in turn, permits articulating member 60 to pivot about pivot post 27 through a range of motion relative to stationary member 20 from a fully open position, as shown in FIG. 4, through approximately 110° of arc (as denoted by reference numeral 69) to a fully closed position, as shown in FIG. 5.

First locking member 80 is shown in FIGS. 6A through 6D as comprising two opposing floating gears 81 connected by transverse post 87. Each floating gear 81 has an associated side recess 82, a top surface having a relatively fine set of ten teeth 83, disposed about a slightly concave arcuate top surface, having a radius of curvature substantially coinciding with the radius of curvature of teeth 68 of articulating member 60, and with teeth 83 being canted in a direction towards the front of hanger 10 upon attachment of first locking member 80 to stationary member 20. Each floating gear 81 further includes a pair of forward-extending jaws 84 forming a channel 86 therebetween, and with the upper jaw 84 having small downwardly-extending hook 85 proximate its distal tip. First locking member 80 is attached to stationary member 20 by extending jaws 84 about second pivot post 28 in a snap-fit engagement, with pivot post 28 being disposed within channel 86 and being retained in place by hook 85. Next, first locking member 80 is rotated slightly until each support post 29 is snap-fit within an associated recess 82. Due to the slightly oversized nature of both jaws 84 and both recesses 82, relative to their cooperating pivot post 28 and support post 29, respectively, first locking member 80 is not tightly held in its attachment to stationary member 20, but is rather permitted to float, or move slightly back and forth in the vertical direction.

Second locking member 100 comprises body 101 having pivot aperture 102, first locking recess 103, locking pin 104, second locking recess 105, handle or lever 106 having gripping surface 107, and stop recess 108. As best seen in FIGS. 4 and 5, second locking member 100 attaches to stationary member 20 via snap-fit engagement, with pivot aperture 102 disposed about second pivot post 28, permitting rotation for second locking member 100 about second pivot post 28. As shown in FIG. 4, rotation of second locking member 100 towards its fully open orientation is limited by the engagement of stop recess 108 with transverse post 87 of first locking member 80. Moreover, as shown in FIG. 5, rotation of second locking member 100 towards its fully closed orientation is limited by the engagement of first locking recess 103 of second locking member 100 with transverse post 87 of first locking member 80. At the same time, rotation of locking member 100 towards its fully closed orientation is further limited by the engagement of second locking recess 105 with first pivot post 27 of stationary member 20. Furthermore, this engagement immediately below locking pin 104 provides a snap-fit locking of second locking member 100 in its fully closed position, as shown in FIG. 5.

Figure 2:
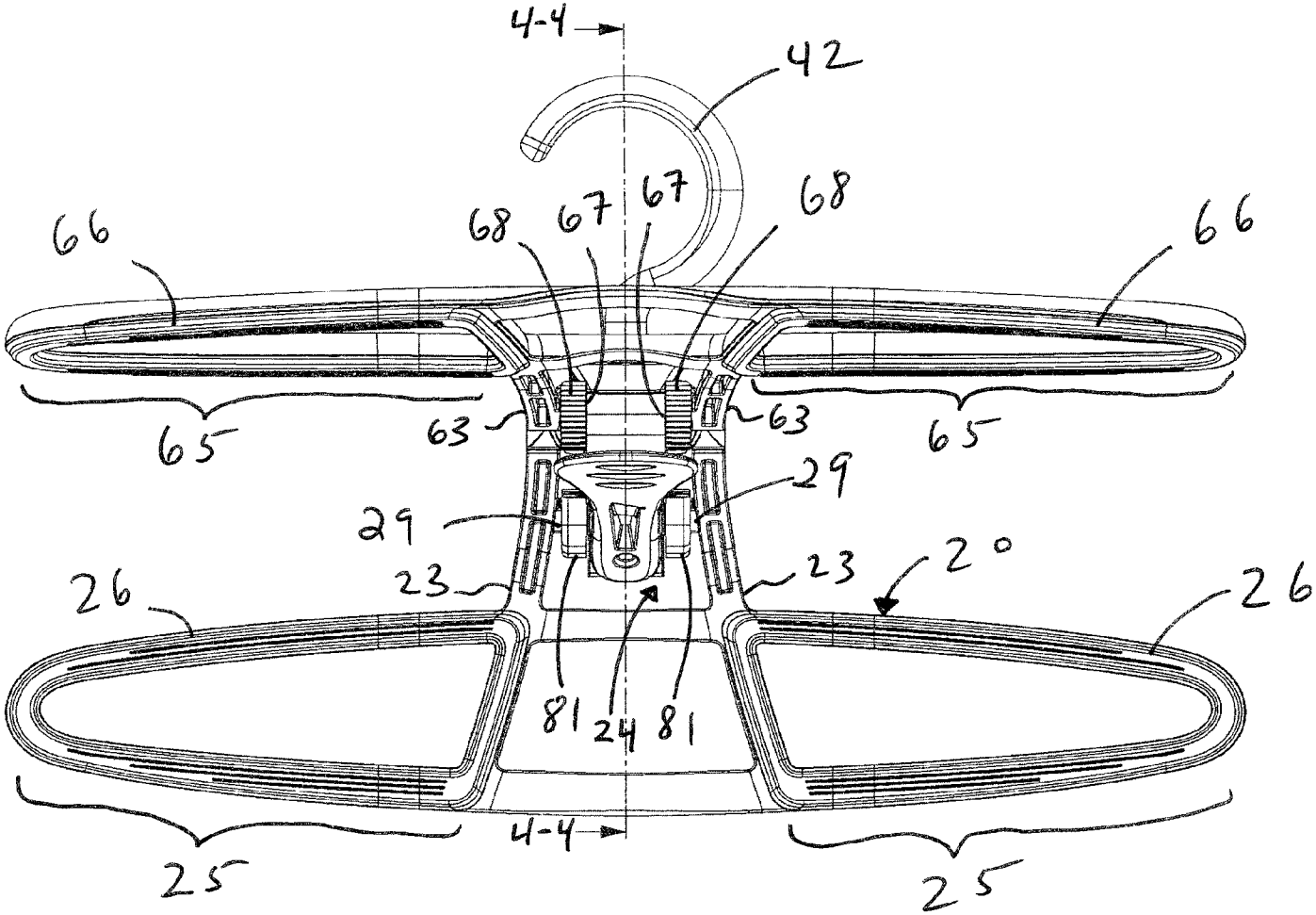
FIG. 2 is an elevated a front view of the garment hanger of FIG. 1, shown in the fully open configuration.
Figure 3:
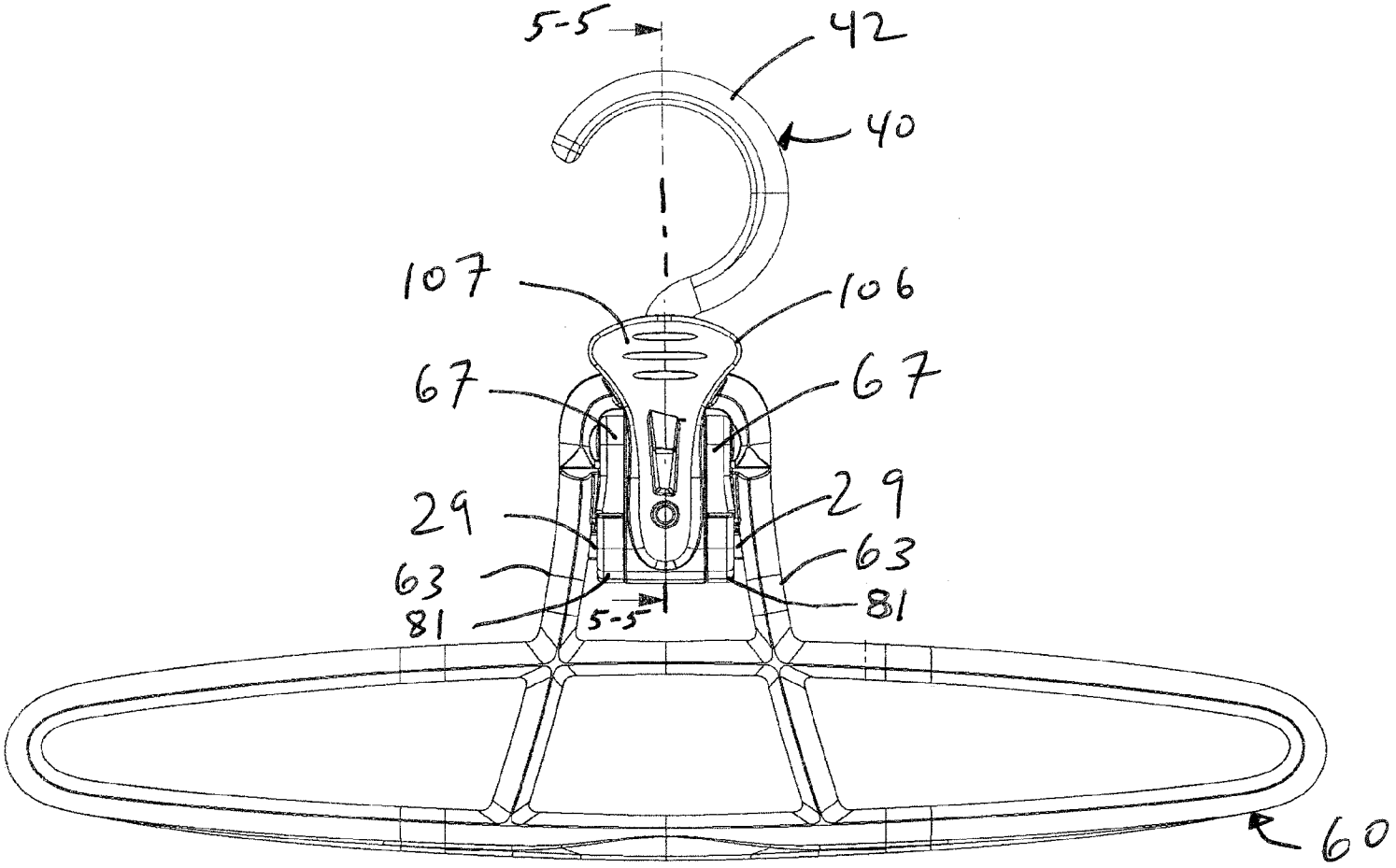
FIG. 3 is a front view of the garment hanger of FIG. 1, shown in the fully closed configuration.

In operation, articulating garment hanger 10 is initially placed in its open orientation of FIGS. 2 and 4, by pulling handle 106 away from first pivot post 27 using gripping surface 107, thereby rotating second locking member 100 about second pivot post 28 in a clockwise direction (as viewed in FIGS. 4 and 5). At the same time, articulating garment hanger 10 is further placed in its open orientation by pulling articulating jaw 65 away from stationary jaw 25, rotating articulating member 60 about first pivot post 27 in a counterclockwise direction (as viewed in FIGS. 4 and 5) and permitting the end of second locking member 100 proximate handle 106 to pass through top gap 64 of articulating member 60. This, in turn, removes any prior engagement of transverse post 87 of first locking member 80 by first locking recess 103 of second locking member 100, thereby permitting first locking member 80 to sag or float slightly downward relative to second pivot post 28, floating gear support posts 29, and stationary member 20 overall.

A portion of a pair of pants, a skirt, or other garment to be hung is then placed against non-slip region 26 of stationary member 20. Next, articulating jaw 65 is rotated towards stationary jaw 25, rotating articulating member 60 about first pivot post 27 in a clockwise direction (as viewed in FIGS. 4 and 5), bringing non-slip region 66 into engagement with an opposing side of the garment to be hung, thus gripping the garment between the opposing jaws of hanger 10. This, in turn, causes rearwardly-angled teeth 68 of articulating member 60 to begin to come into contact and meshing engagement with forwardly-angled teeth 83 of first locking member 80. Inasmuch as first locking member 80 is permitted to sag or float slightly downward relative to second pivot post 28 and floating gear support posts 29, and relative stationary member 20 overall when in this orientation, as described above, the mutual meshing engagement of teeth 68 and 83 is only partial in this orientation, permitting back-and-forth movement of the pair of teeth in a click-stop manner in both the opening and closing directions of articulating member 60. This, in turn, permits the user to finely adjust, and, if necessary, loosen and readjust, the amount of closure of articulating member 60 relative to stationary member 20 to, in turn, finely adjust the desired pressure or tension to be maintained between stationary jaw 25 and articulating jaw 65.

When a desired amount of gripping tension upon the garment to be hung is reached in the manner described above, second locking member 100 is rotated to its fully closed position, as described above, causing first locking recess 103 to fully engage transverse post 87 of first locking member 80. This engagement, in turn, slightly raises first locking member 80 vertically relative to stationary member 20, causing overlapping teeth 68 and 83, previously only partially enmeshed, to become fully enmeshed, thereby precluding any further back-and-forth, click-stop movement of teeth 68 relative to teeth 83 and, accordingly, fully securing jaw 65 adjacent jaw 25 with the desired amount of gripping tension upon the garment to be hung becoming fully locked. At the same time, second locking recess 105 fully engages first pivot post 27 to fully secure second locking member 100 in its fully closed orientation. This fully locked engagement of opposing jaws 25 and 65 with a desired amount of space or tension therebetween remains until handle 106 is pulled away from articulating member 60 to remove the engagement of first locking recess 103 with transverse post 87, permitting first locking member to float or sag back downwards, removing the full meshing engagement of teeth 68 and 83.

A second embodiment of the present articulating garment hanger 10' is shown in FIGS. 7 through 13C as comprising stationary member 20, swiveling hook member 40, articulating member 60, and second locking member 100'. In this embodiment, a floating locking member, analogous to component 80 of the embodiment of FIGS. 1-6, is eliminated, with certain structure of the first locking member being incorporated into a modified, single remaining locking member 100'. Swiveling hook member 40 includes hook 42, sized for use in conjunction with a conventional closet clothing rod, and bottom cavity 41, configured to permit snap-fit attachment of hook member 40 to top pivot post 22 of stationary member 20. Upon such snap-fit engagement, hook member 40 is firmly attached to stationary member 20, yet is permitted to rotate about post 22. This, in turn, permits body 21 of stationary member 20, and all of garment hanger 10 apart from swiveling hook member 40, to rotate in place upon attachment of hook 42 to a closet clothing rod or other suitable support.

In addition to top pivot post 22, body 21 of stationary member 20 further includes two opposing vertical arms 23 having top gap 24 therebetween, stationary jaw 25 having non-slip region 26, first pivot post 27, second pivot post 28, and two opposing support posts 29. Stationary jaw 25 is substantially oval in shape, with vertical arms 23 being integrally formed therewith and extending transversely therethrough. Nonslip region 26 is likewise substantially oval in shape and is disposed about the inwardly-facing periphery of stationary jaw 25. First pivot post 27 extends longitudinally between and immediately behind each of vertical arms 23, immediately above top gap 24, permitting the pivoting attachment of articulating member 60 to stationary member 20. Second pivot post 28 extends longitudinally between and transverse to each of vertical arms 23, permitting the pivoting attachment of second locking member 100' to stationary member 20.

Figure 10:
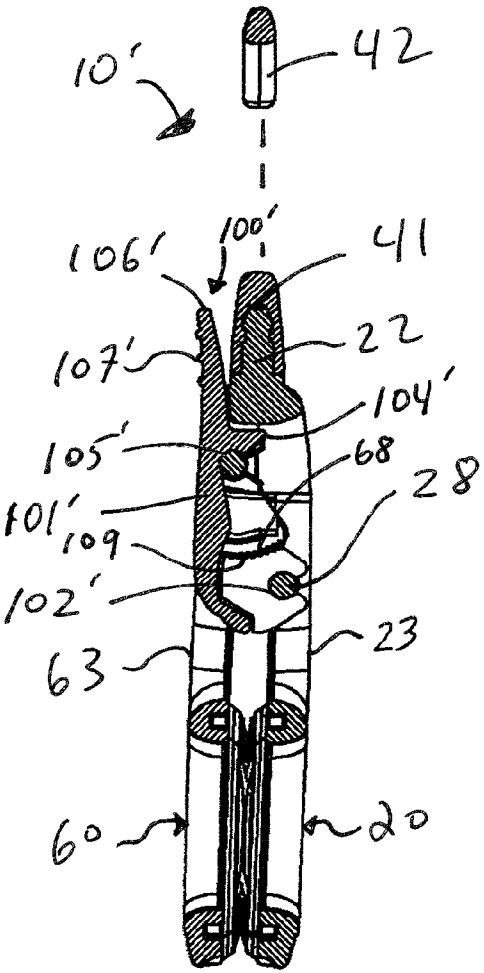
FIG. 10 is a right side sectional view of the garment hanger of FIG. 7, shown in the fully closed configuration and taken generally along lines 10-10 of FIG. 7.
Figure 9:
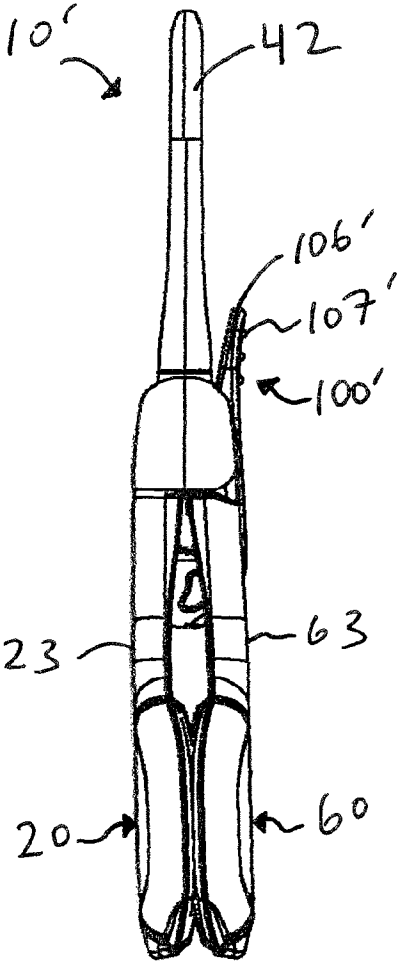
FIG. 9 is a left side view of the garment hanger of FIG. 7.
Figure 12:
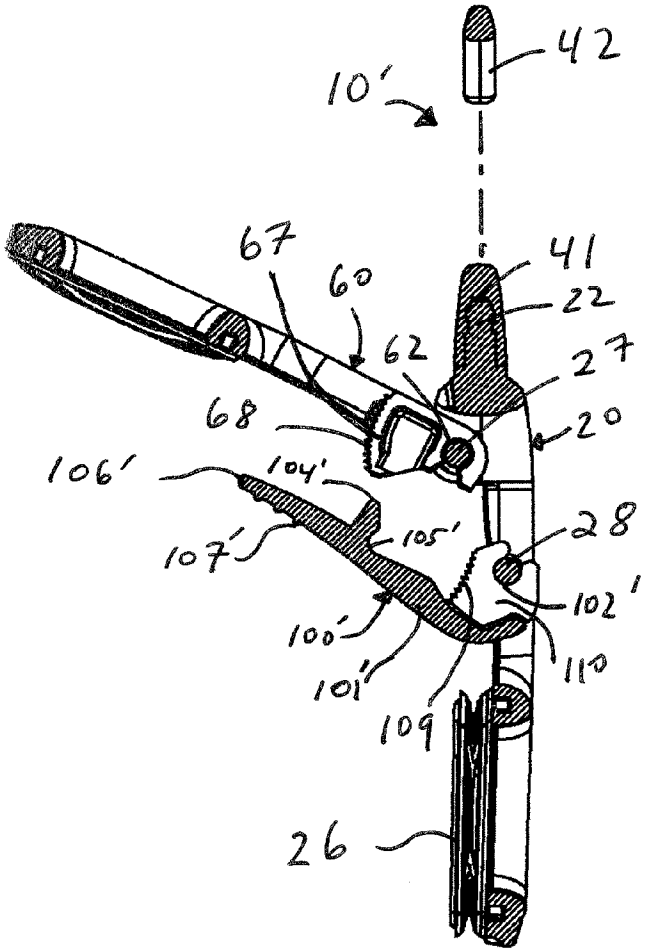
FIG. 12 is a right side sectional view of the garment hanger of FIG. 7, shown in the fully open configuration and taken generally along lines 12-12 of FIG. 8.

Articulating member 60 includes body 61 having pivot aperture 62 disposed proximate a top end, two opposing vertical arms 63 having top gap 64 therebetween, and articulating jaw 65 having non-slip region 66. Articulating jaw 65 is substantially oval in shape, with vertical arms 63 being integrally formed therewith and extending transversely therethrough. Nonslip region 66 is likewise substantially oval in shape and is disposed about the inwardly-facing periphery of articulating jaw 65. Articulating member 60 further includes articulating gear 67 proximate pivot aperture 62, and having a relatively fine set of twelve teeth 68, disposed about a slightly convex arcuate bottom surface of articulating gear 67, with the teeth canted in a direction towards the back of hanger 10 when in the fully closed orientation. As best seen in FIG. 12, pivot aperture 62 permits articulating member 60 to be snap-fit to first pivot post 27 of stationary member 20. This, in turn, permits articulating member 60 to pivot about pivot post 27 through a range of motion relative to stationary member 20 from a fully open position, as shown in FIGS. 11 and 12, through approximately 110° of arc to a fully closed position, as shown in FIGS. 9 and 10.

Locking member 100' comprises body 101' having pivot aperture 102', locking pin 104', locking recess 105', handle or lever 106' having gripping surface 107', and two opposing gears 110, each having a top surface having a relatively fine set of ten teeth 109, disposed about a slightly concave arcuate top surface of gear 110, and having a radius of curvature substantially coinciding with the radius of curvature of teeth 68 of articulating member 60, and with teeth 109 being canted in a direction towards the front of hanger 10' upon attachment of locking member 100' to stationary member 20. As best seen in FIGS. 10 and 12, locking member 100' attaches to stationary member 20 via snap-fit engagement, with pivot aperture 102' disposed about second pivot post 28, permitting rotation for second locking member 100' about second pivot post 28. Moreover, as shown in FIG. 10, rotation of second locking member 100' towards its fully closed orientation is limited by the engagement of locking recess 105' with first pivot post 27 of stationary member 20. Furthermore, this engagement immediately below locking pin 104 provides a snap-fit locking of second locking member 100' in its fully closed position, as shown in FIG. 10.

Figure 11:
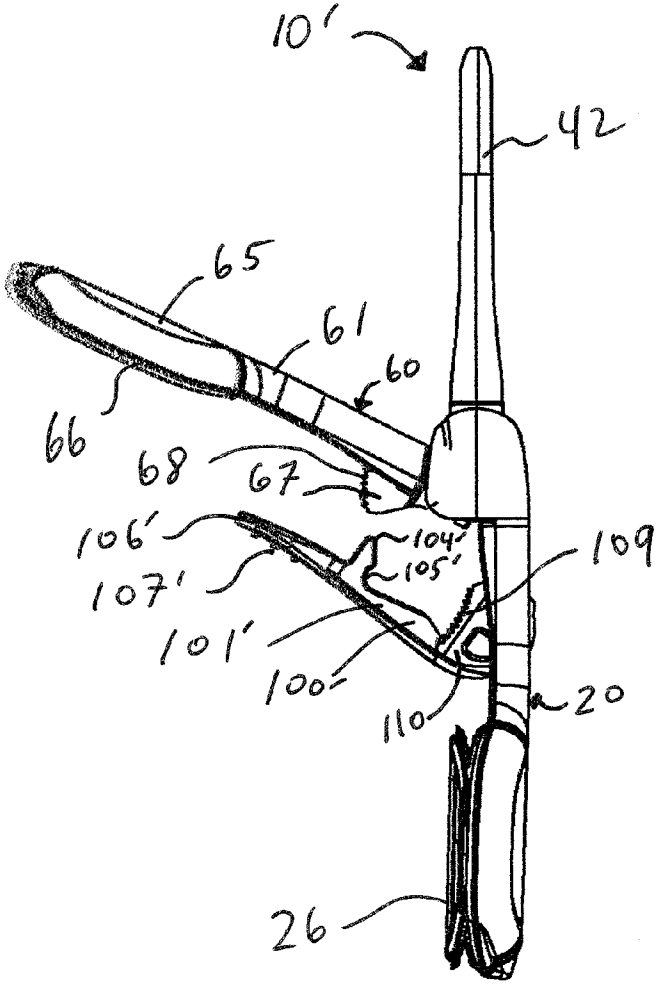
FIG. 11 is a right side view of the garment hanger of FIG. 7, shown in the fully open configuration.
Figure 13A:
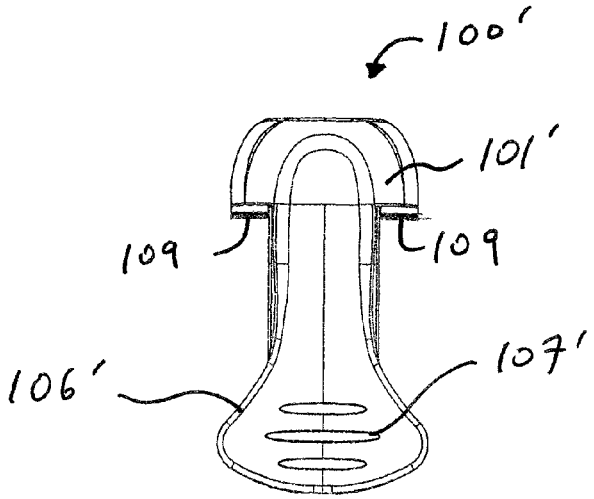
FIG. 13A is an elevated, front view of the locking member component of the articulating garment hanger of FIG. 7.
Figure 13B:
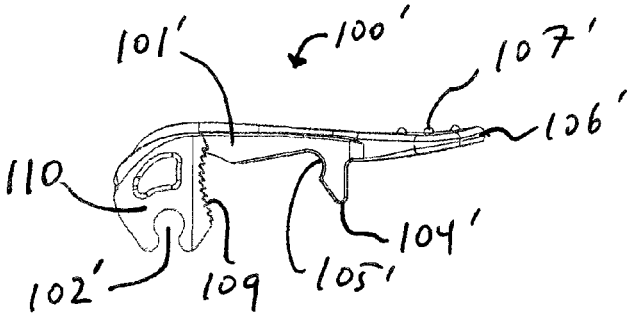
FIG. 13B is a right side view of the locking member component of FIG. 13A.
Figure 13C:
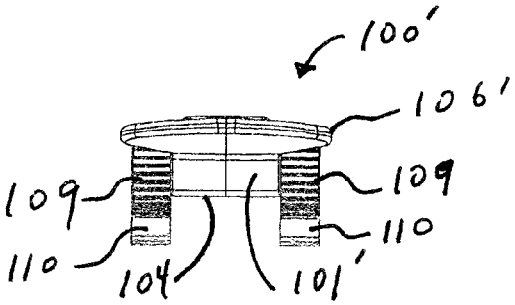
FIG. 13C is a top plan view of the first locking member component of FIG. 13A.

In operation, articulating garment hanger 10' is initially placed in its open orientation of FIGS. 11 and 12, by pulling handle 106' away from first pivot post 27 using gripping surface 107', thereby rotating locking member 100' about second pivot post 28 in a counterclockwise direction (as viewed in FIGS. 11 and 12). At the same time, articulating garment hanger 10' is further placed in its open orientation by pulling articulating jaw 65 away from stationary jaw 25, rotating articulating member 60 about first pivot post 27 in a clockwise direction (as viewed in FIGS. 11 and 12) and permitting the end of locking member 100' proximate handle 106' to pass through top gap 64 of articulating member 60.

A portion of a pair of pants, a skirt, or other garment to be hung is then placed against non-slip region 26 of stationary member 20. Next, articulating jaw 65 is rotated towards stationary jaw 25, rotating articulating member 60 about first pivot post 27 in a counterclockwise direction (as viewed in FIGS. 11 and 12), bringing non-slip region 66 into engagement with an opposing side of the garment to be hung, thus gripping the garment between the opposing jaws of hanger 10'. A desired amount of pressure, or tension upon the garment between non-slip regions 26 and 66 is manually maintained.

With a desired amount of gripping tension upon the garment to be hung being manually maintained, locking member 100' is rotated towards its fully closed position, causing teeth 68 and 109 to begin to become enmeshed, as the opposing teeth engage each other. Inasmuch as locking member 100' and, in turn, teeth 109 are constructed of a sturdy yet somewhat yielding plastic material, the application of manual force to locking member handle 106' causes the individual teeth 109 and 68 to engage and advance past each other in click-stop, ratcheting manner while, at the same time, providing sufficiently strong engagement of the two sets of intermeshing teeth to permit garments to be securely gripped between non-slip regions 26 and 66. At the same time, unwanted disengaging movement of the teeth in response to the gripping force against the garments secured between the hanger arms is inhibited, until sufficient manual reverse force is applied to locking member handle 106' to move the teeth in an opposing direction, again in a ratcheting, click-stop manner. Full clockwise rotation of locking member 100' (as viewed in FIGS. 11 and 12) causes locking recess 105' to fully engage first pivot post 27 to fully secure locking member 100' in its fully closed orientation.

This fully locked engagement of opposing jaws 25 and 65 remains until handle 106' is pulled away from articulating member 60 to remove the engagement of locking recess 105' with first pivot post 27, with sufficient manual reverse force being applied to locking member handle 106' to move teeth 109 and 68 in an opposing direction, relative to each other, again in a ratcheting, click-stop manner.

Stationary member 20, swiveling hook 40, and articulating member 60 may all be constructed of a substantially rigid blended combination of polypropylene and a thermoplastic elastomer. Locking member 100' may be constructed of a polypropylene material that is relatively rigid, yet less rigid and more yielding than the blended material employed in the construction of stationary member 20, swiveling hook 40, and articulating member 60.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of performing the various steps of the invention disclosed herein without departing from the spirit and scope of the invention. The present disclosure is intended to exemplify and not limit the invention.

What is claimed is:

1. A garment hanger, comprising:

a stationary member having a first clamping jaw;

an articulating member having a second clamping jaw and a first set of teeth; and a locking member rotatably movable relative to the stationary member and having a second set of teeth, rotational movement of the locking member causing the first set of teeth to engage the second set of teeth to, in turn, secure the first clamping jaw adjacent the second clamping jaw with a desired degree of tension therebetween;

wherein the locking member is rotatably coupled to the stationary member and rotates about a point of attachment to the stationary member independently of any rotation of the articulating member relative to the stationary member.

2. The garment hanger according to claim 1, wherein the first set of teeth and the second set of teeth are constructed of different materials having different rigidity.

3. The garment hanger according to claim 2, wherein the second set of teeth is constructed of a material that is less rigid than the first set of teeth.

4. The garment hanger according to claim 1, wherein the second set of teeth engages the first set of teeth in a click-stop manner upon rotation of the locking member.

5. A garment hanger, comprising:

a stationary member having a first clamping jaw;

an articulating member having a second clamping jaw and a first set of teeth; and a locking member rotatably movable relative to the stationary member and having a second set of teeth, rotational movement of the locking member causing the first set of teeth to engage the second set of teeth to, in turn, secure the first clamping jaw adjacent the second clamping jaw with a desired degree of tension therebetween;

wherein at least a portion of the locking member engages at least a portion of the articulating member in a snap-fit manner upon rotation of the locking member to a fully closed position.

6. The garment hanger according to claim 5, wherein the locking member includes a recess that is engaged by a post portion of the stationary member.

7. The garment hanger according to claim 5, wherein the articulating member is pivotally attached to the stationary member by snap-fit engagement of at least a portion of the articulating manner with the post portion of the stationary member.

8. A garment hanger, comprising:

a stationary member having a first clamping jaw;

an articulating member having a second clamping jaw;

a first locking member; and a second locking member, movement of the second locking member prompting movement of the first locking member between a first orientation and a second orientation, and causing the first locking member to fully engage at least a portion of the articulating member to, in turn, secure the first clamping jaw adjacent the second clamping jaw with a desired degree of tension therebetween when the first locking member is in the second orientation.

9. The garment hanger according to claim 8, wherein the articulating member includes a first set of teeth and the first locking member includes a second set of teeth.

10. The garment hanger according to claim 9, wherein the first set of teeth and the second set of teeth are fully enmeshed when the first locking member is in the second orientation.

11. The garment hanger according to claim 9, wherein the first set of teeth and the second set of teeth are only partially enmeshed when the first locking member is in the first orientation, permitting relative click-stop movement of the articulating member relative to the first locking member.

12. The garment hanger according to claim 1, wherein:

the articulating member and the locking member are pivotally movable relative to each other about a first axis of rotation;

the locking member is rotatably movable about the stationary member about a second axis of rotation; and the first axis of rotation and the second axis of rotation are in a spaced apart, parallel orientation relative to each other.

* * * * *